United States Patent [19]

Nash, Jr.

[11] 4,107,807

[45] Aug. 22, 1978

[54] PORTABLE TACK CLEANING MACHINE

[76] Inventor: Bernard J. Nash, Jr., P.O. Box 358A, Rte. 1, Glen Allen, Va. 23060

[21] Appl. No.: 821,378

[22] Filed: Aug. 3, 1977

[51] Int. Cl.[2] ..... A46B 13/04

[52] U.S. Cl. ..... 15/21 C; 15/21 D; 15/77

[58] Field of Search ..... 15/4, 21 C, 34, 39, 15/40, 74, 77, 102

[56] References Cited

U.S. PATENT DOCUMENTS

| | | | |
|---|---|---|---|
| 2,962,741 | 12/1960 | Petrillo | 15/77 X |
| 3,396,422 | 8/1968 | Haverberg | 15/77 |

FOREIGN PATENT DOCUMENTS

| | | | |
|---|---|---|---|
| 2,036,156 | 1/1972 | Fed. Rep. of Germany | 15/77 |

*Primary Examiner*—Edward L. Roberts

*Attorney, Agent, or Firm*—Griffin, Branigan and Butler

[57] ABSTRACT

A portable, tack cleaning machine having a housing which supports a horizontally-mounted rotary, cylindrical feeder-brush at least partially immersed in a cleaning fluid tank located in the bottom of the housing, and a rotary, scrubbing brush vertically mounted above and in contact with the feeder-brush. The brushes are powered by electric motors using an ordinary 60-cycle outlet as a power source. The housing has entrance and exit openings located adjacent the interface of the two brushes. In addition, the housing is hinged on one side along its longitudinal axis providing access to the brushes, tank, and driving assembly. A control clip is also disclosed for grasping and guiding a piece of tack to be cleaned through the machine.

10 Claims, 5 Drawing Figures

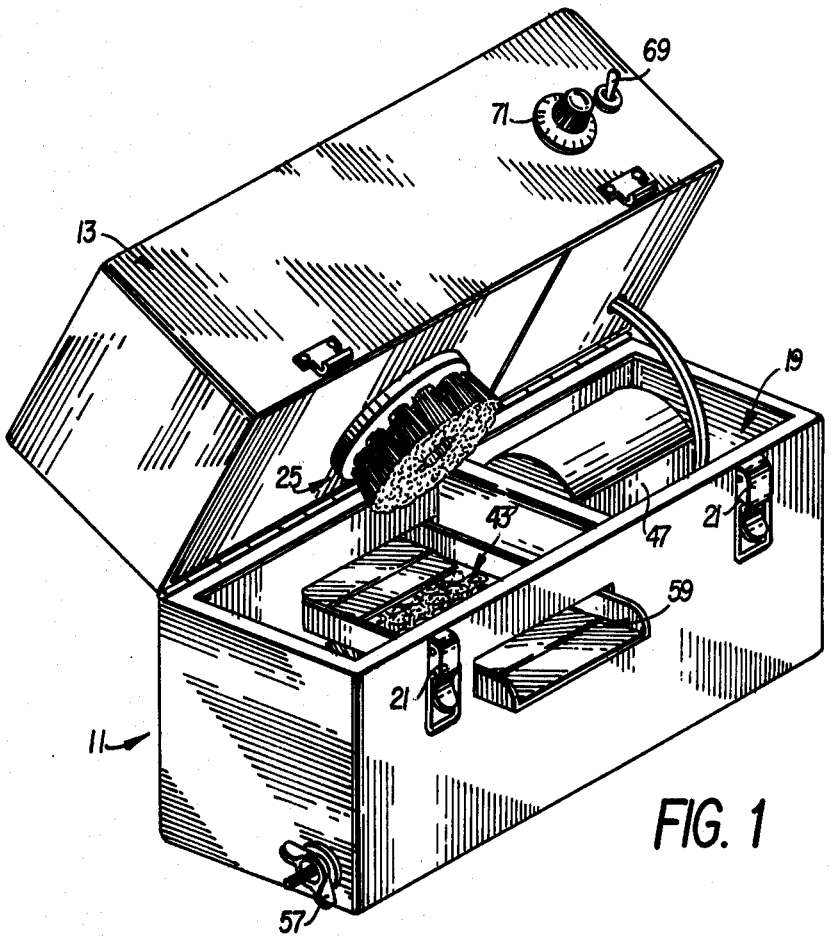
FIG. 1
FIG. 2
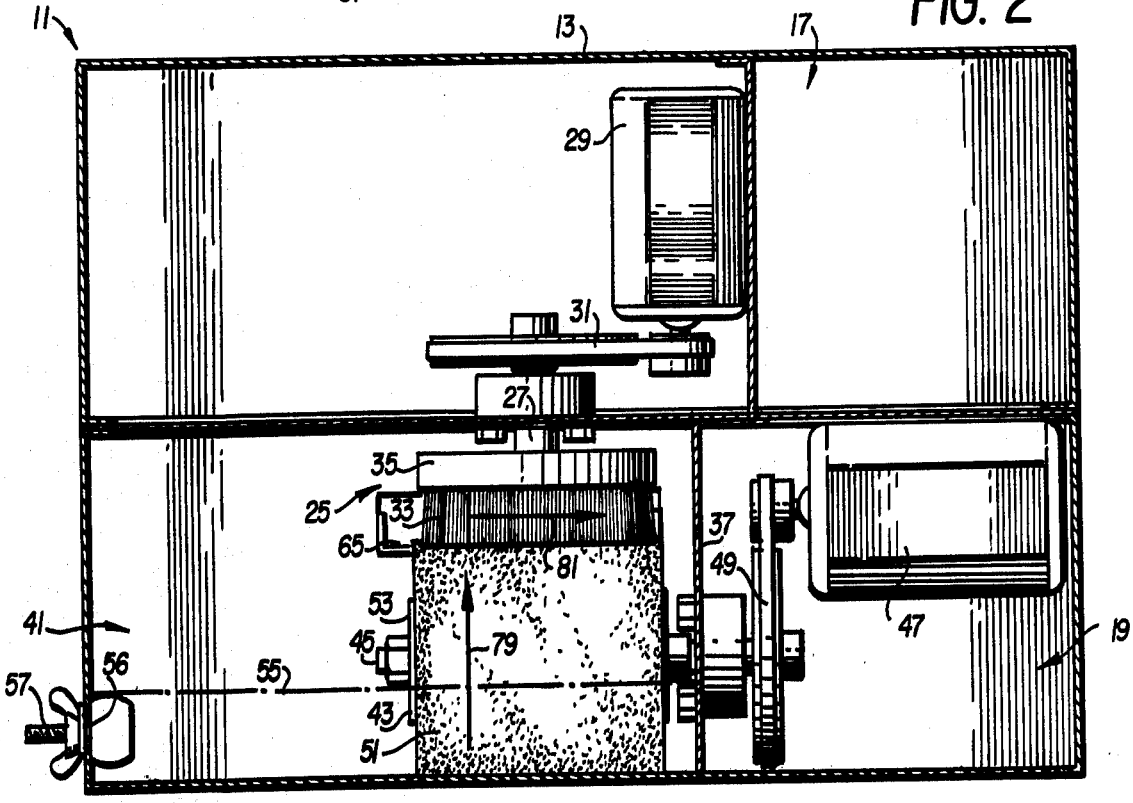

PORTABLE TACK CLEANING MACHINE

BACKGROUND OF THE INVENTION

This invention relates broadly to a tack cleaning apparatus and more particularly, to an apparatus for scrubbing and brushing a strip of material such as flat leather goods, tack, or stable equipment.

The close association through the ages between man and the horse has given rise to the need for specialized equipment such as bridles, reins, etc. which serve both the rider and horse. Invariably, this equipment becomes soiled during use and requires cleaning. In the past, the removal of saliva, caked dirt and perspiration has been accomplished by the tedious task of scrubbing the equipment with a hand brush dipped in a cleaning solution — a process that is time-consuming and dirty.

With the development of mechanized power sources, the horse's use as a beast of burden has diminished; but equestrian events, county fairs, race horsing, and the rodeo still flourish. These events, being held all over the country, require perforce a great deal of travel for horse and owner.

Therefore, it is an object of this invention to provide a mechanized means for cleaning soiled stable equipment; and it is a further object of this invention to provide such a cleaning apparatus that is portable.

Another object of this invention is to provide a simple and easy-to-use tack cleaning machine which is easy to maintain.

A further object is to provide a tack cleaning machine which is inexpensive to manufacture and use.

SUMMARY

According to aspects of the present invention, a portable tack cleaning machine has a vertically-mounted scrubbing brush in contact with a horizontally-mounted, cylindrical feeder-brush. A housing supports the brushes and their associated driving assemblies and is hinged on one side along a longitudinal axis to provide access to the interior for replacement of brushes and general maintenance. A tank located in the bottom of the housing provides a source of cleaning fluid which is conveyed to the cleaning area by the feeder-brush. Additionally, the housing has entrance and exit openings located adjacent to the interface between the feeder and scrubbing brush. In one embodiment, a control clip is used to grasp the tack to be cleaned; and, control the speed at which it passes through the machine. The housing, brushes, and tank are lightweight and compact providing a portable arrangement using an ordinary 60-cycle outlet for a power source.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refers to the same parts throughout the different views. The drawings are not necessarily to scale, emphasis instead being placed upon illustrating the principles of the invention in a clear manner.

FIG. 1 is a pictorial view of a portable tack cleaning machine of this invention;

FIG. 2 is a front cut-away view of the FIG. 1 structure;

PREFERRED EMBODIMENT OF THE INVENTION

Figure 4:
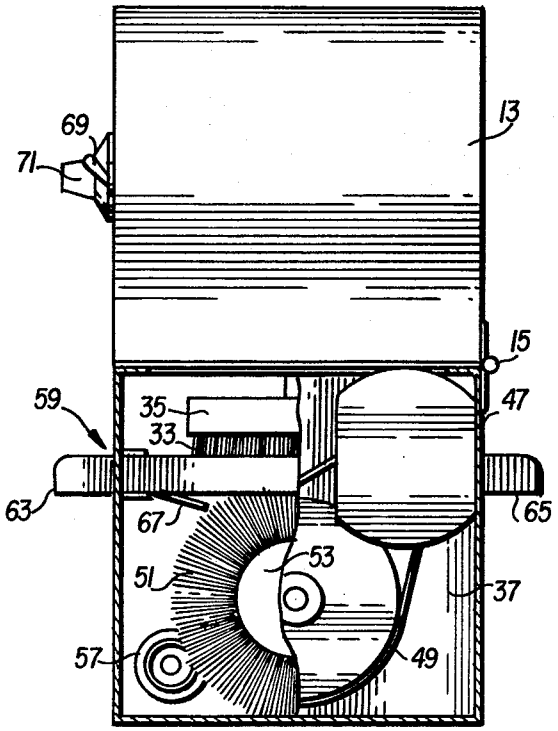
FIG. 4 is a side view, in partial section of FIG. 3.
Figure 3:
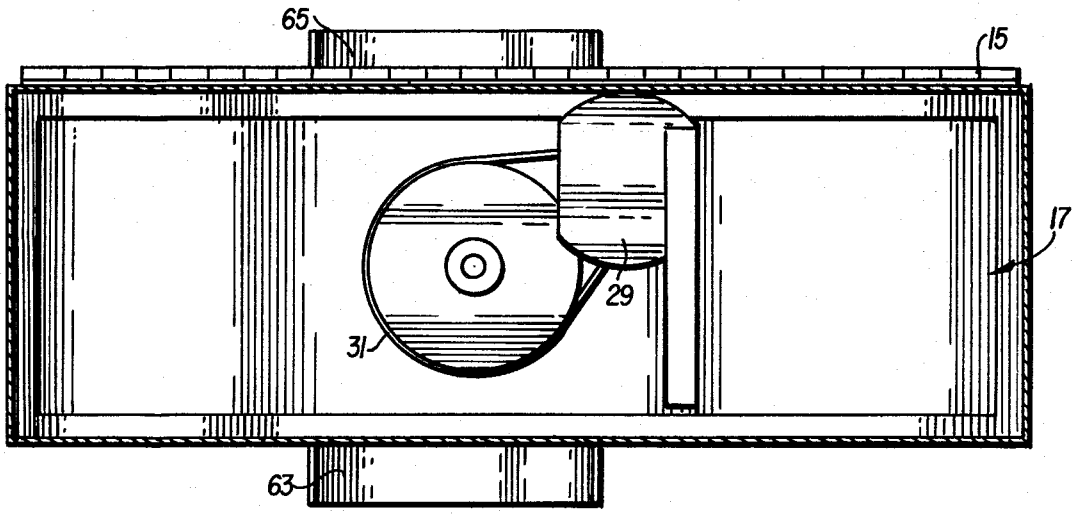
FIG. 3 is an elevated, cut away view of the upper compartment illustrated in FIG. 1.

Referring to FIGS. 1–4, a tack cleaning machine 11 has a housing 13 hinged at 15 on one side along a longitudinal axis forming an upper compartment 17, and a lower compartment 19. The housing is provided with suitable latching means 21 for securing the housing in a closed position.

The upper compartment 17 of the housing 13 supports a rotary, scrubbing and cleaning brush 25 attached to a drive shaft 27 and connected to an electrical motor 29 by a suitable drive train such as a drive belt 31. Bristles 33 of the brush 25 are secured to a disc 35 and extend parallel to the axis of rotation of the drive shaft 27. The bristles 33 may be constructed of soft nylon—this being the equivalent to soft horse hair; and, the disc 35 can be constructed from wood.

The lower compartment 19 is divided into two sections by a partition 37 which is attached to housing 13 in a fluid-tight arrangement to form a motor compartment 39 and an open-topped tank 41 for containing a cleaning fluid. A horizontally-mounted, rotary, cylindrical feeder-brush 43 is affixed to partition 37 and has a drive shaft 45 attached to a motor 47 by a belt 49. In this respect, bristles 51 of feeder-brush 43 are constructed from materials similar to bristles 15, but the bristles 51 extend radially from core 53 so that they are perpendicular to the axis of rotation of feeder-brush 43. The core 53 may be constructed from a suitable material including wood.

When the tank 41 is filled with cleaning fluid 55, which may be any type of cleaning fluid designed to clean and/or preserve leather, the feeder-brush 43 has its downwardly extending bristles 51 at least partially immersed in the liquid. A drain hole 56 and drain plug 57 furnish the tank 41 with a means for draining the cleaning fluid when the machine is not in use.

Referring to FIG. 4, the housing 13 is equipped with an entrance 59 and exit 61. A lip 63 of the entrance 59 supports the tack during cleaning; and the exit 61 is similarly equipped with a lip 65. Affixed to the bottom edge of the lip 63 is a deflector plate 67 which prevents cleaning fluid 55 from spraying out of the machine during usage.

An on/off switch 69 is used to activate motors 29 and 47; and the speed of operation of the motors can be varied by a conventional variable control switch 71.

Figure 5:
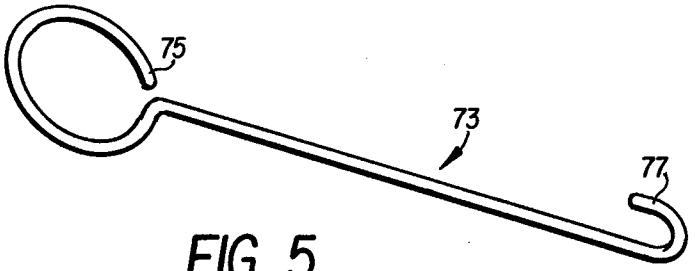
FIG. 5 is a side view of a control clip.

FIG. 5 illustrates a control clip 73 having a handle 75 and a tack grasping hook 77. In one embodiment, the control clip 73 is used to control the speed at which a piece of tack is driven through the machine by the feeder-brush 19.

In operation, the tack cleaning machine is suitably supported and plugged into an ordinary 60-cycle electrical outlet. Latches 21 are released and the upper compartment 17 is pivoted upwardly and back, exposing the open-topped tank 41 and feeder-brush 19. With the tack cleaning machine in the open position, the tank 41 is filled with cleaning fluid 55, and then the upper compartment 17 is secured to the lower compartment 19 by the latching means 21.

The operator then activates the machine by means of on/off switch 69. This causes feeder-brush 43 to rotate as indicated by arrow 79 in FIG. 2. Similarly, scrubbing and cleaning brush 25 is rotated as indicated by arrow 81 in FIGS. 2 and 4. The speed of rotation of the brushes is controlled by variable control switch 71. Hence, once the operator is satisfied with the variable control switch setting, the machine is ready for use.

In the above regard, a piece of tack is placed on the lip 63 of the entrance 59 and inserted by the operator so that the inward extending portion of the tack moves into engagement with the feeder-brush 43 which is rotating away from the entrance 59. As the tack contacts bristles 51, the friction and direction of rotation of the feeder-brush 43 draws the tack to the interface between the brushes so that the scrubbing and cleaning brush 25 can remove dirt and grit. The lips 63 and 65 act to support the tack with respect to the brushes during cleaning while cleaning fluid 55 is conveyed by the feeder-brush 43 to the scrubbing and cleaning brush 25. Once the entire length of the tack has been exposed to the cleaning brush 25, the tack exits the machine via exit 61. The operator then reinserts the tack with the opposite side exposed to the cleaning brush 25 which completes the cleaning. It is understood, that this operation may be repeated a number of times depending upon the degree of scrubbing necessary to clean the tack; and, the setting of the variable control switch 71 can be changed as desired.

To drain the cleaning fluid 55, when the machine is not in use or needs to be transported, the operator simply removes the drain plug 57 of drain 56.

A second embodiment of the invention is disclosed in which the control clip is used to assist and control the speed at which the tack moves through the machine. In this embodiment, the operator first attaches a piece of tack to the control clip 71 using the tack grasping hook 77. The operator then places the free end of the tack onto the lip 63 of the entrance 59 so that the tack engages feeder-brush 43. As the feeder-brush 43 draws the tack into the machine, the operator controls the speed at which the tack is drawn through the machine by exerting a force on the control clip 73 either in concert with, or in opposition to, opposite to that force drawing the tack into the machine. In this manner, the operator can control the speed at which the tack is passed through the machine.

It is understood that both the feeder-brush 43 and the cleaning and scrubbing brush 25 can be removably attached to their respective drive shafts so that they may be detached for replacement and repair.

While the invention has been particularly shown and described with reference to preferred embodiments thereof, it will be understood by those skilled in the art that various alterations in form and detail may be made therein without departing from the spirit and scope of the invention. For example, many types of cleaning fluid can be employed and an exit guide can be employed to guide tack that has been cleaned on one side into a second set of brushes (not shown) for cleaning the opposite side.

The embodiments of the invention in which an exclusive property or privilege is claimed are defined as the following:

1. A tack cleaning machine comprising:

a housing;

a rotary, cleaning and scrubbing brush mounted in said housing and having bristles extending substantially parallel to the axis of rotation;

a rotary, cylindrical feeder-brush mounted in said housing for rotation on a horizontal axis and having outwardly extending radial brushes substantially perpendicular to the axis of rotation;

a cleaning fluid tank mounted in said housing, said feeder-brush being disposed above said tank so that said bristles thereof are adapted to extend into said cleaning fluid;

said cleaning and scrubbing brush being mounted contiguous to said feeder-brush so that the respective axes of rotation of said brushes are perpendicular to one another;

means to drive said brushes;

said housing having entrance and exit means to provide for ingress and egress of said tank, and disposed adjacent to the interface between said brushes.

2. The machine of claim 1 wherein said cleaning-fluid tank includes a drainage means.

3. The machine of claim 1 including a tack grasping control clip for controlling the motion of said tack through said machine.

4. The machine of claim 1 in which said brushes are removable for replacement.

5. The machine of claim 1 including means for varying the speed of said rotary brushes.

6. The machine of claim 1 in which said housing is hinged on one side along a longitudinal axis thereof so that an upper portion is pivotally movable from a lower portion thereof to provide access to the interior of said machine.

7. The machine of claim 1 includes individual means for driving each of said rotary brushes.

8. The machine of claim 1 in which said entrance and exit means are provided with tack supporting lips.

9. A tack cleaning machine comprising:

a housing adapted to be hinged on one side along a longitudinal axis thereof so that an upper portion is pivotally removable from a lower portion thereof to provide access to the interior of said machine;

a rotary, cylindrical, removably mounted feeder-brush supported in said housing for rotation on a horizontal axis and having outwardly extending radial brushes substantially perpendicular to the axis of rotation;

a rotary, cleaning and scrubbing brush removably mounted in said housing and having bristles extending substantially parallel to the axis of rotation, said scrubbing brush being mounted contiguous to said feeder-brush so that the respective axes of rotation of said brushes are substantially perpendicular to one another;

a cleaning-fluid tank mounted in said housing and having a drainage means; wherein said feeder-brush being disposed above said tank so that said bristles thereof are adapted to extend into said cleaning fluid;

entrance and exit means to provide for ingress and egress of said tack and having tack supporting lips; and means to drive said brushes at varying speeds.

10. The machine of claim 9 including a tack grasping control clip for controlling the motion of said tack through said machine.

* * * * *